US007444848B2

(12) United States Patent
Krueger-Eppstein

(10) Patent No.: US 7,444,848 B2
(45) Date of Patent: Nov. 4, 2008

(54) PROCESS FOR MILLING METAL PARTS

(75) Inventor: Albrecht Krueger-Eppstein, Stuttgart (DE)

(73) Assignee: Daimler AG, Stuttgart (DE)

( * ) Notice: Subject to any disclaimer, the term of this patent is extended or adjusted under 35 U.S.C. 154(b) by 409 days.

(21) Appl. No.: 11/200,817

(22) Filed: Aug. 10, 2005

(65) Prior Publication Data

US 2006/0032052 A1 Feb. 16, 2006

(30) Foreign Application Priority Data

Aug. 10, 2004 (DE) ..... 10 2004 038 856

(51) Int. Cl.
*B21D 28/26* (2006.01)

(52) U.S. Cl. ..... 72/130; 29/897.2; 228/158; 228/170; 72/177

(58) Field of Classification Search ..... 72/130, 72/132, 129, 177; 29/897.2, 897.31, 897.32, 29/33 Q, 33 S; 228/149, 158, 160, 170, 173.6, 228/144, 146, 147, 150

See application file for complete search history.

(56) References Cited

U.S. PATENT DOCUMENTS 1,295,769 A * 2/1919 Kux ..... 72/129
1,793,352 A * 2/1931 Bell ..... 72/130
3,135,311 A * 6/1964 Green ..... 72/130
3,362,056 A * 1/1968 Preller et al. ..... 29/897.35
3,393,547 A * 7/1968 Kortan ..... 72/131
3,470,598 A * 10/1969 Berthelsen ..... 29/897.312
4,011,704 A * 3/1977 O'Konski ..... 52/733.3
5,395,036 A * 3/1995 Sturrus ..... 228/146

* cited by examiner

*Primary Examiner*—Daniel C Crane
(74) *Attorney, Agent, or Firm*—Stephan A. Pendorf; Patent Central LLC

(57) ABSTRACT

Process for manufacture of self reinforced sheets or shape parts (9) by rolling at least one metal strip (1, 2), which during roller processing is guided through a gap formed between work rollers, wherein at least in one area of the metal sheet (2) through holes (7) are introduced and the area of the metal sheet with through holes (4, 6) is brought together with an area of the same metal sheet without through holes (5) or at least one further metal sheet without through holes (1) and rolled, so that a new metal strip (1, 2), sheet or shaped part (9) is formed, as well as a sheet or shaped part obtainable by this process, wherein the sheet or shape part is comprised of two metal parts (4, 6) joined by welding or adhering, wherein at least one metal part is provided with perforations (7), which correspond to the recesses of the self reinforced structure.

7 Claims, 2 Drawing Sheets

Fig.1
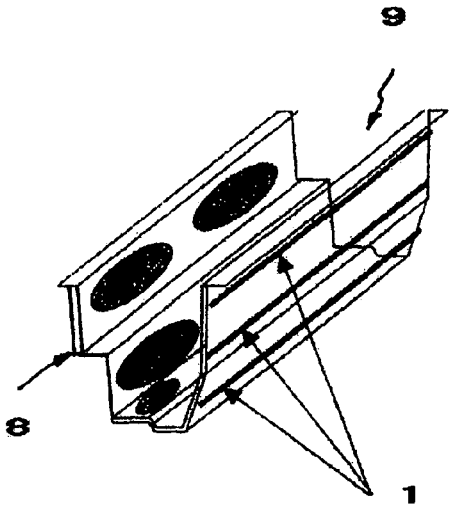
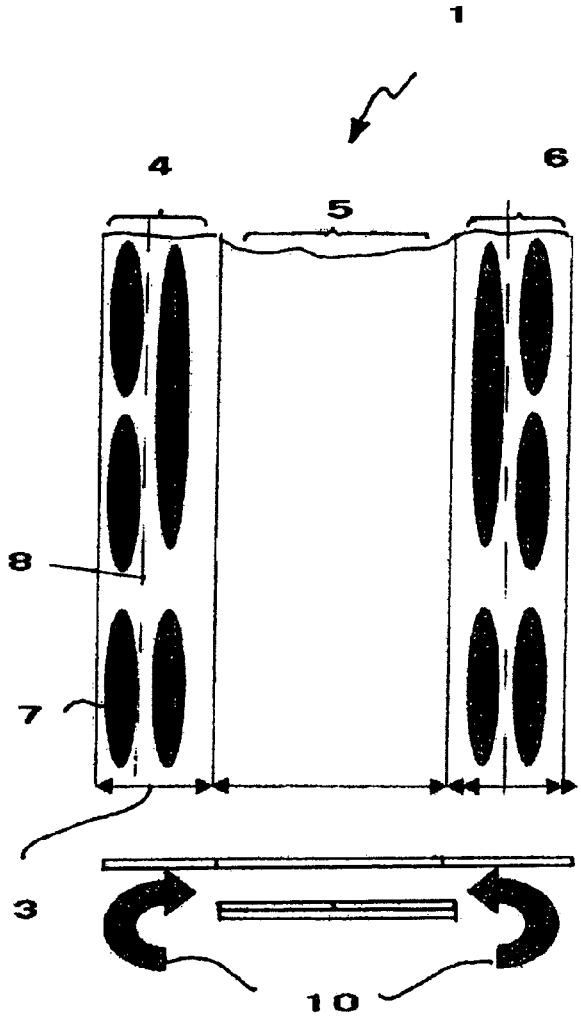
Fig.2

PROCESS FOR MILLING METAL PARTS

BACKGROUND OF THE INVENTION

1. Field of the Invention

The invention concerns a process for roller milling, hereafter referred to as rolling, of metal parts such as metal continuous sheets and/or shaped parts, which are guided during the rolling process through a gap formed between two work rollers.

2. Related Art of the Invention

The shaping process using roller profiling in place of deep drawing for the production of shaped parts is gaining increasing importance. For example, DE 198 07 830 A1 discloses a process for producing body and chassis components for vehicles of longitudinally seam-welded aluminum pipes or open rolled shapes. For this, a continuous sheet, usually referred to as a strip, is deformed in a continuous process first selectively over its width by means of rollers to a material thickness according to the required wall thickness. Thereafter the material is deformed by means of shaping rollers in a roller profiling assembly into a closed pipe shape or an open shape. In the case of a pipe shape, the side edges of the original planar semi-finished product are longitudinally welded with each other and subsequently the weld seam is deburred. The strip can in certain cases also be deformed locally over its length to various wall thicknesses by means of previously set up rollers. Thereby various wall thicknesses can be achieved not only over the circumference of the profile but rather also over the length of the profile, that is, in the axial direction. Thereby the wall thicknesses can be adapted over the length of the pipe or open profile to the most diverse locations of loads. Beyond this, a further material and weight savings is made possible.

From DE 199 39 166 A1 a process for flexible rolling of a metal strip is known, wherein the metal strip during the roller processing is led between a roller gap formed between two work rollers, and the roller gap during the roller processing is selectively moved, in order to achieve a varying of the strip thickness over the length of the metal strip. Thereby a good planar surface is achieved, namely even in the case of very broad metal strips. This is achieved thereby, that during each adjustment of the roller band or immediately thereafter, the bending lines of the work rollers are adjusted for achievement of a planar surface of the metal sheet depending upon the selected roller gap. This manufacturing process for production of a strip is laborious and expensive. Besides this, there occurs in this case a cross-section change only in the longitudinal direction of the roller sheet, and further, this is only suitable for sheets with low to average hardness.

In particular for light weight construction in the field of motor vehicles it is necessary to use sheets and shapes that are load-justified. This means that the construction component is to be produced or designed with the smallest possible wall thickness and is to be self-reinforced only in the particularly loaded or stressed areas. The self-reinforcement can therein be accomplished by a greater wall thicknesses or a particular structural design.

The invention is concerned with the task of providing a process for economical production of rolled sheets or shaped parts with local self-reinforcement areas, in particular for motor vehicle components.

SUMMARY OF THE INVENTION

The task is solved in accordance with the invention thereby, that (1) at least one area of a metal sheet is provided with through-holes or perforations prior to the roller processing, such that deforming or bringing together of the perforated metal parts at least with the not perforated metal part, this forms a new metal sheet. The metal parts can therein be formed using the same metal sheet or different metal sheets. Thereby one achieves a metal sheet with targeted adjustable variable thickness. In the areas of the metal sheet corresponding to the holes, a recess is formed. The metal sheet can therewith, by variation of the wall strength or thickness, be adapted precisely to the stiffness or rigidity requirements. Overall, the component can be made lighter by the recess of the material and therewith can be produced more economical, and the until now very expensive known manufacturing process can be dispensed with. The areas of the metal sheet not provided with recesses form a self reinforced area in the later-stage sheet or shape.

It is advantageous to join the two metal parts or metal sheets rigidly with each other. This is achieved for example in that subsequent to the deforming process these are welded to each other and therewith in simple manner a new metal sheet or continuous sheet is formed. An adhesion or gluing is also possible, wherein the joined metal parts are preferably adhered or glued over a large surface area over the entire contact surface with each other.

A supplemental possibility is, in accordance with a further development of the invention, that (3) the metal part or metal sheet is comprised, with regard to its longitudinal direction, of two or more sections, wherein at least the two outer sections are provided with numerous through holes. A metal sheet or continuous strip of this type can be produced very lightweight and economically.

It is further advantageous that (4) the through holes provided in the metal sheets are arranged in such a manner that, following the deforming process of the metal sheet into a beam, they lie between the bends of the beam. Thereby the stiffness of the metal sheet is substantially improved.

A simple manufacturing process is achieved thereby, that (5) the metal sheet is comprised of a first section with through holes and a second section without through holes, wherein the two sections, subsequent to imparting through holes, are divided approximately along the middle, folded upon each other, adhered and/or welded to each other, and subsequently deformed into a shaped part.

According to a preferred embodiment of the inventive solution it is finally provided that (6) a through holed or punched metal part or metal sheet, during the shaping process, is joined with a no-perforated metal part or metal sheet, and shaped into a shaped part.

It is further advantageous (7) that the metal sheet is comprised of at least two joined metal parts, wherein at least one metal part is provided with through holes.

Depending upon requirements of the sheet or shaped part to be provided, the stiffness of the metal sheet can be varied thereby that (8) the through holes exhibit among themselves a separation that is substantially equally spaced or of varying spacing.

In connection with the inventive design and arrangement it is advantageous that (9) the through holes are substantially the same size or of varying size and that (10) the holes are circular, multi-sided, oval and/or ellipse shape. Thereby an influence can be exercised upon the stiffness of the metal sheet in likewise simple manner.

Further advantages and details of the invention can be seen in the Patent Claims and the detailed description and in the figures.

BRIEF DESCRIPTION OF THE DRAWINGS

Therein there is shown:

FIG. 1 a perspective representation of a beam with through holes,

FIG. 2 a top view of a roller sheet prior to the deformation process.

DETAILED DESCRIPTION OF THE INVENTION

Figure 3:
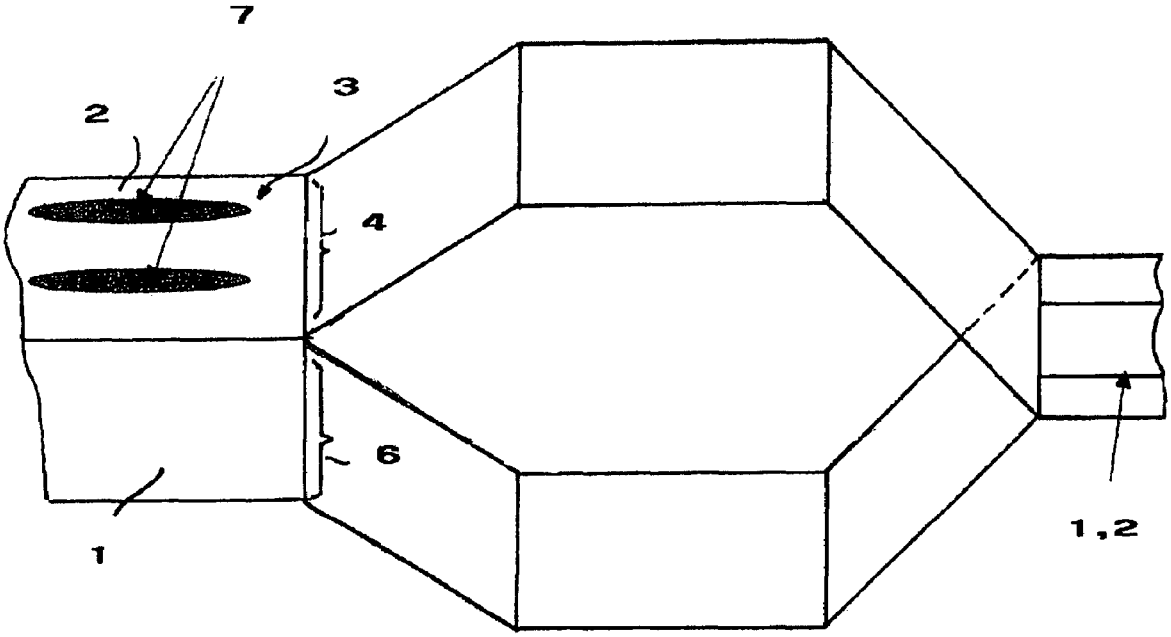

FIG. 3 two metal sheets arranged side-by-side, which are separated following through holing, superimposed and welded.

In FIGS. 2 and 3 there is shown respectively one process for rolling metal parts, in particular metal sheets 1, 2, which during roller profiling are lead through a gap formed between two or more sequentially arranged work rollers or shaping rollers, not shown in the drawings. After completion of the roller process one obtains the shaped beam 9 represented in FIG. 1, which according to the illustrative embodiment is in the shape of a side door-sill for a motor vehicle. This beam 9 is comprised of two metal parts 4, 5 laid upon each other, which after the roller process are joined to each other or, as the case may be, are adhered or welded and thereby produce a new shaped metal strip, which subsequently is deformed into the beam 9 according to FIG. 1.

In FIG. 2 a first manufacturing process is schematically shown. The metal sheet 2 is comprised of three sections 4, 5, 6, wherein the two outer sections 4, 6 are provided with numerous through holes 7 exhibiting various shapes. After the metal sheet 1 is rolled to the desired thickness, the two outer areas 3 are folded inwardly upon the middle section 5 according to arrow 10 and are rigidly connected or, as the case may be, adhered or welded therewith to form laminae. Thereby one obtains a new sheet, which can be further processed or, as the case may be, deformed or shaped, for example into the shaped part or, as the case may be, beam or door sill 9 for the door area of a motor vehicle. The beam 9 is comprised of a double sheet, wherein the one side, as already explained, exhibits no through holes 7 and the other side exhibits numerous adjacent located through holes 7. On the basis of the through holes 7 one obtains in simple and economical manner a component with varying cross section.

According to another embodiment according to FIG. 3 the metal sheet 2 can be comprised of a first section with through holes 7 and a second section exhibiting no through holes 7, wherein the two sections 4, 5 after the provision of through holes are divided approximately along the center and folded by deformation upon each other, adhered and/or welded with each other and subsequently deformed to a beam 9. It is however also possible to roll two separate metal sheets 4 and 5 and after the perforation process of one metal sheet 4 to assemble the two metal sheets 4, 6 into a new metal sheet and to join these rigidly with each other or, as the case may be, to adhere or to weld them to each other.

The through holes 7 can among themselves be approximately equally spaced or may vary in spacing. It is further possible that the through holes 7 have approximately the same size or different size. The through holes 7 can be circular, multi-sided, oval and/or ellipse shaped.

The through holes 7 provided in the metal sheets 2 are so arranged, that subsequent to the deformation of the metal sheet 2 into the beam 9 they lie between the bends 8 of the beam 9.

According to FIG. 3 the one perforated metal part or metal sheet 2 can, during the shaping process, be joined with a not perforated metal part or metal sheet 1 and thereby simultaneously be shaped into a new sheet-metal part or, according to FIG. 1, into a shaped part. It is also possible that more than two metal parts are laid upon each other and joined rigidly with each other or, as the case may be, welded. Thereby it is advantageous when at least one metal layer is provided with through holes. Depending upon the type of shape the metal part can be divided into two (FIG. 3), three (FIG. 2) or more than three sections, which in alternating manner are provided with through holes.

The invention claimed is:

1. A process for manufacturing self-reinforced metal sheets or shapes (9), comprising:

guiding a strip of sheet metal through a gap formed between two work rollers in a roller milling process for rolling the sheet metal to a desired thickness, introducing through holes or perforations (7) in at least one area of the roller metal sheet (2) thus forming at least one perforated area (4, 6) and at least one non-perforated area (5), and folding the at least one perforated area (4, 6) onto the at least one non-perforated area (5) so that laminae are established with the non-perforated area closing off the through holes or perforations of the metal sheet, and roller deforming the laminae so that a new metal strip, sheet or shape (9) is formed.

2. The process according to claim 1, wherein the at least one perforated area and the at least one non-perforated area are welded or adhered to each other.

3. The process according to claim 1, wherein the metal sheet with regard to its longitudinal direction is comprised of two or more sections (4, 5, 6), wherein at least two outer sections (4, 6) are provided with numerous perforations (7).

4. The process according to claim 1, wherein the through holes or perforations (7) provided in the metal sheet (2) are arranged in such a manner that, after the deforming process of the metal sheet (2) into the shape (9), they lie between bends (8) of the shape (9).

5. The process according to claim 1, wherein the metal sheet (2) is comprised of a section (4) exhibiting through holes (7) and a second section (5) exhibiting no through holes (7), wherein the two sections (4, 5), following the process of introducing holes, are divided approximately along the center of the metal sheet (2), folded upon each other, adhered and/or welded to each other and subsequently deformed into a shaped part.

6. A process for manufacturing self-reinforced metal sheets or shapes (9), comprising:

guiding a strip of sheet metal through a gap formed between two work rollers in a roller milling process for rolling the sheet metal to a desired thickness, introducing through holes or perforations (7) in the rolled metal sheet, providing at least one non-perforated metal sheet, placing the perforated metal sheet together with the at least one non-perforated metal sheet on top of one another so that laminae are established with the non-perforated metal sheet closing off the through holes or perforations of the perforated metal sheet, and roller deforming the laminae so that a new metal strip, sheet or shape (9) is formed.

7. The process according to claim 6, wherein subsequent to the deforming process the two metal sheets are welded or adhered to each other.

* * * * *